US006899185B2

(12) United States Patent
Yagisawa et al.

(10) Patent No.: US 6,899,185 B2
(45) Date of Patent: May 31, 2005

(54) BEACH CLEANER

(75) Inventors: Katsuichi Yagisawa, Saitama (JP); Takashi Ohzeki, Saitama (JP); Yoshinobu Itani, Saitama (JP); Yasuji Hashimoto, Saitama (JP); Hidekazu Sakai, Saitama (JP); Takashi Shinozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/134,733

(22) Filed: Apr. 30, 2002

(65) Prior Publication Data

US 2002/0178623 A1 Dec. 5, 2002

(30) Foreign Application Priority Data

May 30, 2001 (JP) ..... 2001-163464

(51) Int. Cl.[7] ..... A01B 43/00

(52) U.S. Cl. ..... 171/143; 171/DIG. 2; 171/102; 171/106; 171/135; 171/139; 171/144; 171/63

(58) Field of Search ..... 171/DIG. 2, 141, 171/104, 103, 102, 105, 106, 107, 111, 134, 135, 136, 139, 140, 144, 143, 11, 45, 46, 63, 2, 83, 84; 172/80

(56) References Cited

U.S. PATENT DOCUMENTS

| | | | | | |
|---|---|---|---|---|---|
| 99,575 | A | * | 2/1870 | Knight | 171/11 |
| 498,885 | A | * | 6/1893 | Mercer | 171/83 |
| 643,740 | A | * | 2/1900 | Cecil | 171/135 |
| 2,419,154 | A | * | 4/1947 | O'Brien | 171/98 |
| 3,362,480 | A | * | 1/1968 | Barber | 171/89 |
| 3,643,920 | A | * | 2/1972 | Widegren et al. | 254/124 |
| 3,963,079 | A | * | 6/1976 | Carlucci | 172/200 |
| 4,014,390 | A | * | 3/1977 | Teixeira | 171/124 |
| 4,047,573 | A | * | 9/1977 | Aoyama | 171/14 |
| 4,050,518 | A | * | 9/1977 | Gilmour | 171/116 |
| 4,142,585 | A | * | 3/1979 | Bohner et al. | 171/82 |
| 4,156,466 | A | * | 5/1979 | Caldwell | 172/4.5 |
| 4,241,792 | A | * | 12/1980 | Kratzer | 171/63 |
| 4,425,723 | A | * | 1/1984 | Erlandsen | 37/316 |
| 4,482,019 | A | * | 11/1984 | Murphy | 171/63 |
| 4,593,426 | A | * | 6/1986 | Chrisley | 15/84 |
| 5,133,413 | A | * | 7/1992 | Baxter | 171/63 |
| 5,160,034 | A | * | 11/1992 | Potter | 209/38 |
| 5,284,212 | A | * | 2/1994 | Huckins et al. | 172/44 |
| 5,291,819 | A | * | 3/1994 | Hambric | 89/1.13 |
| 5,305,834 | A | * | 4/1994 | White | 171/63 |
| 5,351,761 | A | * | 10/1994 | Henthorn | 171/13 |
| 5,398,767 | A | * | 3/1995 | Warke | 172/21 |
| 5,479,992 | A | * | 1/1996 | Bassett | 172/4 |
| 5,806,607 | A | * | 9/1998 | Sanders | 172/253 |
| 6,073,701 | A | * | 6/2000 | Kleinemenke | 171/31 |
| 6,540,030 | B2 | * | 4/2003 | Ohzeki et al. | 171/1 |

* cited by examiner

*Primary Examiner*—Victor Batson
(74) *Attorney, Agent, or Firm*—Birch, Stewart, Kolasch & Birch, LLP

(57) ABSTRACT

A beach cleaner that is simple in configuration and light in weight and can be manufactured at a low cost. The beach cleaner is easy with regard to maintenance and inspection and can efficiently reclaim various kinds of refuse scattered on a beach. A beach cleaner includes a traveling body with ski members disposed at four corner portions of a frame having a substantially quadrangular shape. The beach cleaner is towed along a surface F of sandy soil by a traction vehicle R. A bar-like scraper is provided at a lower portion of a front portion of the traveling body and extends in a widthwise direction of the traveling body through a scraper supporting member for scraping up refuse on the sandy soil while the traveling body is operating. A refuse reclamation section is provided on the traveling body rearwardly of the bar-like scraper for collecting pieces of refuse scraped up and thrown rearwardly by the bar-like scraper onto a net member.

18 Claims, 9 Drawing Sheets

BEACH CLEANER

CROSS-REFERENCE TO RELATED APPLICATIONS

The present application claims priority under 35 USC 119 to Japanese Patent Application No. 2001-163464 filed on May 30, 2001 the entire contents thereof is hereby incorporated by reference.

BACKGROUND OF THE INVENTION

1. Field of the Invention

This invention relates to a beach cleaner for reclaiming various kinds of refuse scattered on a beach or the like.

2. Description of Background Art

Various kinds of refuse such as fragments of fishing net, rope, vinyl string, waste paper, pieces of wood, a empty cans, glass bottles, PET bottles and caps therefor, and cigarette butts are scattered on a beach or the like. As a beach cleaner for reclaiming such pieces of refuse as mentioned above is disclosed in the Official Gazette, for example, Japanese Utility Model Laid-open No. Hei 6-3907.

The beach cleaner disclosed in the Official Gazette mentioned above is configured such that a collector is provided that rotates horizontally along an earth surface at a front portion of a machine body of the traction type. Pieces of refuse such as empty cans and waste paper scattered on the earth are collected by the collector and guided rearwardly by guide plates provided on both sides of the collector so that they are reclaimed into a collection bag.

However, since the beach cleaner described above is configured such that the collector is rotated through a transmission mechanism by power from a vehicle which tows the machine body, it is disadvantageous in that not only is the power of the vehicle consumed but also the entire configuration of the apparatus is complicated. In addition, the weight increases and the price of the beach cleaner increases. Further, since the structure is complicated as described above, the beach cleaner is disadvantageous also in that complicated maintenance and inspection operations are required.

SUMMARY AND OBJECTS OF THE INVENTION

The present invention has been made in view of such a circumstance as described above. It is an object of the present invention to provide a beach cleaner which is simple in configuration and light in weight and can be manufactured at a low cost. In addition, the present invention is easy with regard to maintenance and inspection and can efficiently reclaim various kinds of refuse scattered on a beach.

The present invention is characterized in the following points in order to solve the subject described above.

In particular, according to the present invention, a beach cleaner towed by a traction vehicle to travel on sandy soil and for reclaiming refuse scattered on the sandy soil includes a traveling body having a frame formed from a longitudinal member extending in a traveling direction and a transverse member extending in a widthwise direction perpendicular to the longitudinal member for being towed by the traction vehicle through a towed portion provided at a front portion of the frame. A bar-like scraper is provided at a lower portion of a forward portion of the traveling body in such a manner so as to extend in the widthwise direction of the traveling body for scraping up the refuse on the sandy soil during the operation of the traveling body. A refuse reclamation section is provided on the traveling body rearwardly of the bar-like scraper for collecting the refuse scraped up by the bar-like scraper.

With the beach cleaner, when the traveling body is towed by the traction vehicle to travel on a beach, since the bar-like scraper is provided such that it extends in the widthwise direction of the traveling body, the sand of the sandy soil is dug up over a wide range by the bar-like scraper, and pieces of refuse in the sand are efficiently thrown rearwardly together with pieces of refuse on the surface and the sand so that they are collected with certainty by the refuse reclamation section. Consequently, a reclaiming operation for cans, PET bottles and caps therefor and comparatively small pieces of refuse such as wood pieces scattered on the beach is performed efficiently.

According to the present invention, the beach cleaner includes a bar-like scraper that has a transverse section formed in a circular shape.

With the beach cleaner, since the bar-like scraper has a transverse section formed in a circular shape, it is moved smoothly with reduced resistance in the sandy soil, and pieces of refuse in the sand are efficiently dug up.

According to the present invention, the beach cleaner includes a bar-like scraper with a transverse section formed in a crescent shape and has an upper surface inclined such that a leading portion thereof in the traveling direction of the traveling body is positioned lower than a trailing portion thereof.

With the beach cleaner, pieces of refuse of the sandy soil are scooped up and thrown upwardly and rearwardly by the inclined upper surface of the bar-like scraper so that they are collected precisely by the refuse reclamation section.

According to the present invention, the beach cleaner includes a bar-like scraper with an inclined flat plate secured thereto and the flat plate has an upper surface inclined such that a leading portion thereof in the traveling direction of the traveling body is positioned lower than a trailing portion thereof.

With the beach cleaner, since the bar-like scraper is provided with a comparatively wide scooping up surface by the inclined flat plate, pieces of refuse of the sandy soil are scooped up more effectively and reclaimed by the refuse reclamation section.

According to the present invention, an inclination angle of the upper surface of the bar-like scraper for each cleaner is variable.

With the beach cleaner, the rearward dispersion distance of pieces of refuse is adjusted by adjusting the inclination angle of the upper surface of the bar-like scraper, and pieces of refuse are reclaimed efficiently.

According to the present invention, the beach cleaner includes a bar-like scraper wherein the piercing amount into the sandy soil is adjustable.

With the beach cleaner, the rate of refuse reclaimed from the sand is adjusted by adjusting the piercing amount of the bar-like scraper into the sandy soil.

According to the present invention, the beach cleaner includes a pair of ski-like members for contacting with the sand that are provided at least at the opposite side positions of a front portion of the frame.

With the beach cleaner, traveling of the traveling body on the sandy soil is performed smoothly and the piercing amount of the bar-like scraper into the sandy soil is maintained stably by the ski-like members.

According to the present invention, the beach cleaner includes ski-like members that are provided so that the mounting height from the sandy soil surface to the frame is adjustable.

With the beach cleaner, the piercing amount of the bar-like scraper into the sandy soil is adjusted appropriately by adjusting the mounting height of the frame from the surface of the sandy soil by the ski-like members.

According to the present invention, the beach cleaner includes a refuse reclamation section with a grid-like member and a net member stretched on the grid-like member.

With the beach cleaner, pieces of refuse scooped up together with the sand and thrown rearwardly by the bar-like scraper are separated from the sand and collected by the net member and reclaimed efficiently by the reclamation member.

According to the present invention, the beach cleaner includes a refuse reclamation section that is removably supported on the traveling body.

With the beach cleaner, by preparing and exchangeably using a plurality of net members for the refuse collection member which are different in size of the meshes, pieces of refuse are separated depending upon the size, type or the like and reclaimed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, a beach cleaner according to an embodiment of the present invention is described with reference to FIGS. 1 to 6. The beach cleaner 1 according to the present embodiment is towed by a traction vehicle R such as a buggy or a tractor having three or four wheels for traveling on irregular ground. In this embodiment, the traction vehicle R travels on a beach to reclaim pieces of refuse such as empty cans scattered on the beach.

Figure 1:
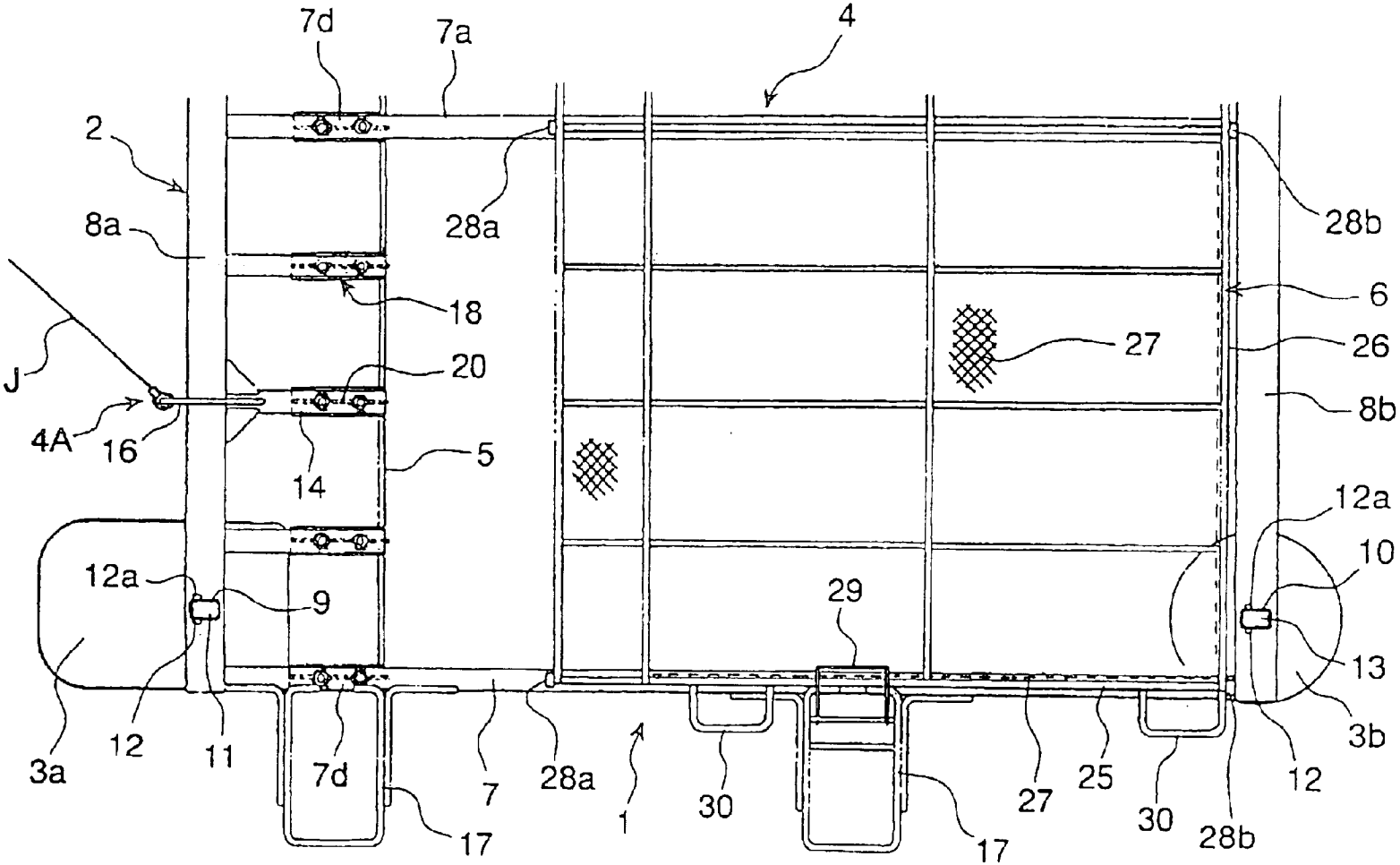
FIG. 1 is a plan view of a beach cleaner according to an embodiment of the present invention.
Figure 3:
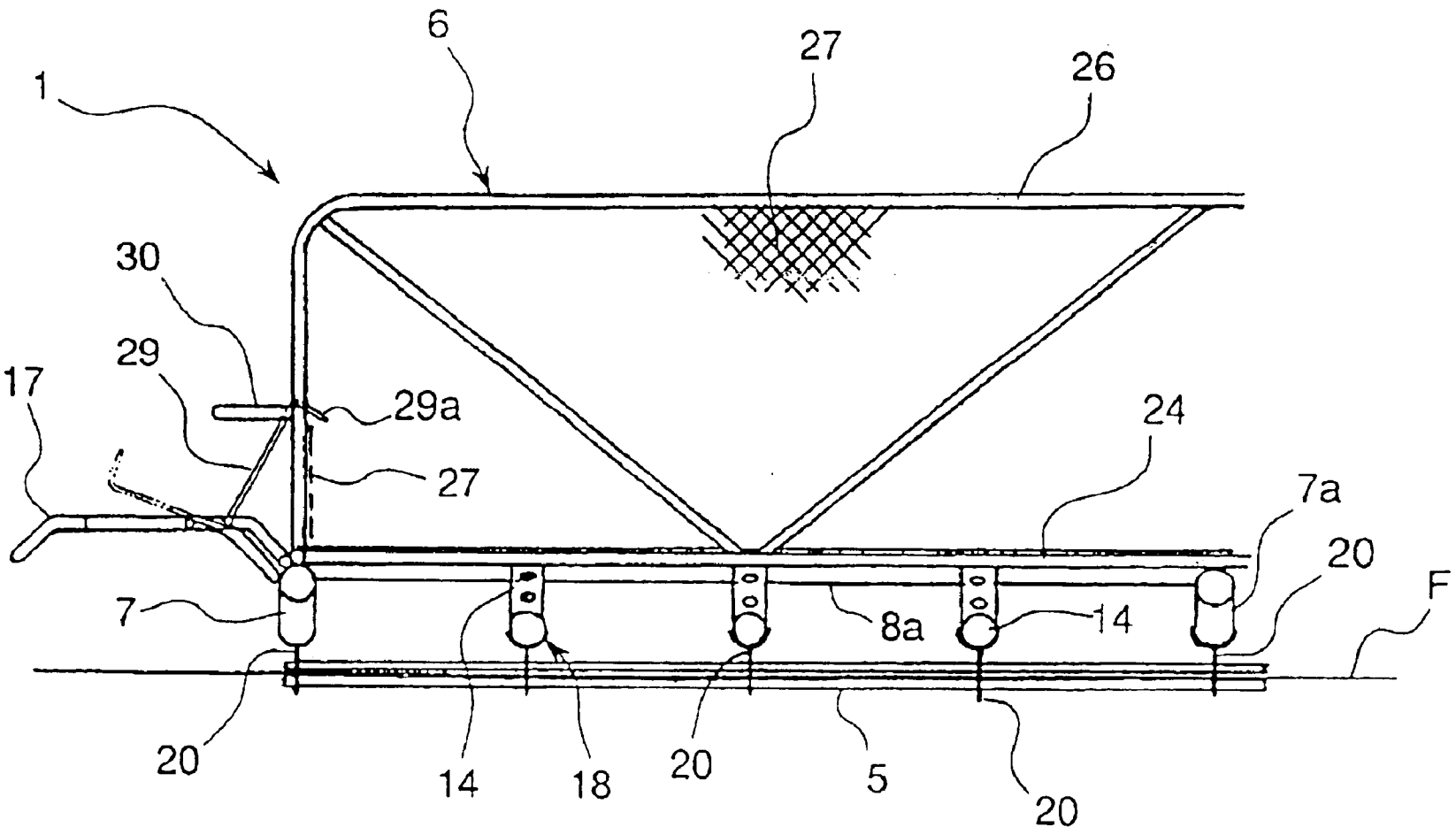
FIG. 3 is a sectional view taken along line X—X of FIG. 2.

It is to be noted that the beach cleaner 1 described above is formed symmetrically with respect to the center in the widthwise direction thereof in an upward and downward direction in FIG. 1 and leftward and rightward direction in FIG. 3 on the opposite sides thereof, one of the opposite sides thereof is not shown in FIGS. 1 and 3.

Figure 2:
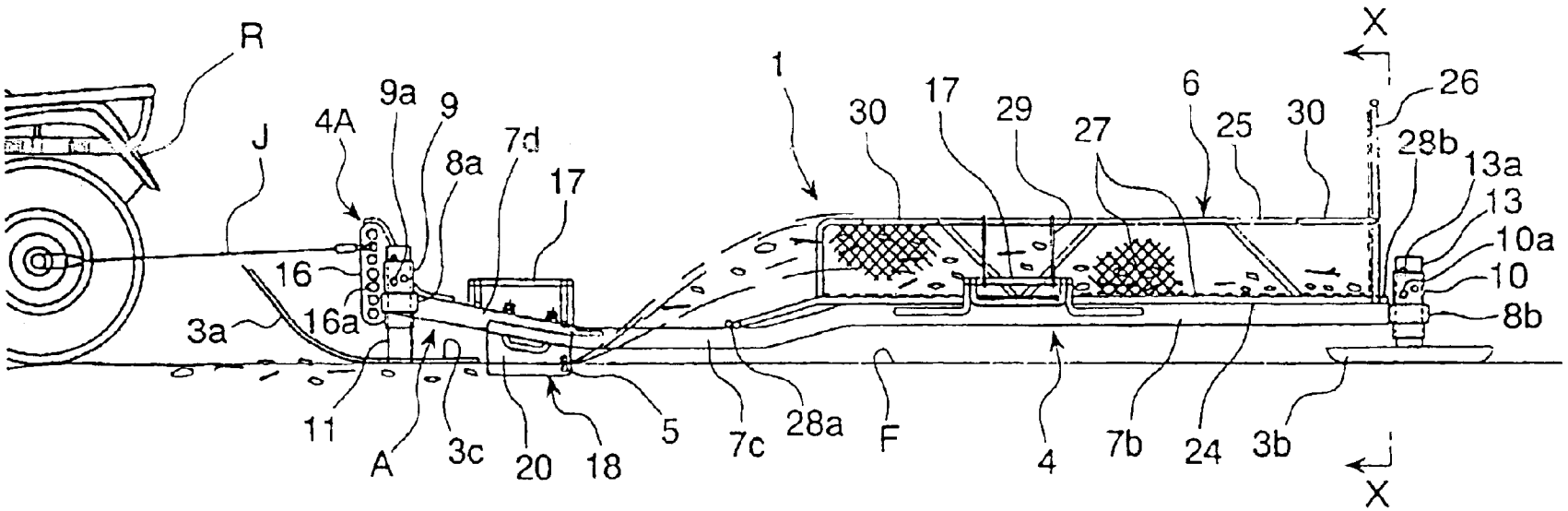
FIG. 2 is a side elevational view of the beach cleaner.

As shown in FIGS. 1 to 3, the beach cleaner 1 described above includes a traveling body 4 which in turn includes a frame 2 having a substantially quadrangular shape as viewed in plan and front and rear ski members 3*a* and 3*b* disposed at the four corners of the frame 2 for contacting with sandy soil. The beach cleaner 1 is towed at a towed portion 4A provided at a front portion of the frame 2 by the traction vehicle R. A bar-like scraper 5 is provided at a lower portion of a front portion of the traveling body 4 and extending in a widthwise direction of the traveling body 4 for scraping up refuse on the sandy soil while the traveling body 4 is being operated. A refuse reclamation section 6 is provided on the traveling body 4 rearwardly of the bar-like scraper 5 for collecting the refuse scraped up by the bar-like scraper 5.

The frame 2 is formed in a quadrangular shape such that longitudinal members 7, 7 (one side is not shown) on the opposite sides extending in a traveling direction (leftward and rightward direction in FIGS. 1 and 2) of the traveling body 4 and a longitudinal member 7*a* disposed at the center between the longitudinal members 7, 7 are connected integrally at front and rear end portions thereof to front and rear transverse member 8*a* and 8*b* which extend in the widthwise direction (widthwise direction of the traveling body 4) perpendicularly thereto.

The longitudinal members 7 and 7*a* are each formed from a cylindrical member which has a horizontal portion 7*b* on the rear side from a central portion thereof in the forward and backward direction and has, on the front side from the central portion thereof, an inclined portion 7*d* bent upwardly past a lower horizontal portion 7*c* formed a little lower than the horizontal portion 7*b*.

Further, the transverse members 8*a* and 8*b* are each formed from an angular tubular member, and support members 9 and 10 each in the form of an angular tube are securely mounted at portions near to the opposite ends of the transverse members 8*a* and 8*b* such that they extend upwardly and downwardly therethrough. The support members 9 and 10 have bolt holes 9*a* and 10*a* perforated at positions thereof above the transverse members 8*a* and 8*b* such that they extend in a transverse direction therethrough.

Each of the front ski-like members 3*a* has a forwardly and backwardly elongated rectangular shape as viewed in plan and is formed in such a shape that a front half thereof is curved upwardly as viewed in side elevation, and a support post 11 in the form of an angular tube having a bolt hole 11*a* perforated in a transverse direction therethrough is secured vertically to an upper surface of a horizontal portion 3*c* of a rear half portion of each of the front ski-like members 3*a*. The front ski-like members 3*a* are attached to the frame 2 by inserting the support posts 11 into the support members 9 and securing the support posts 11 to the support members 9 by means of bolts 12 screwed in the bolt holes 9*a* and 11*a* and nuts 12*a* screwed on the bolts 12 (See FIG. 4).

Each of the support posts 11 has a plurality of bolt holes 11*a* provided at positions displaced from each other in the upward and downward direction. By changing the bolt holes 11*a* to be adjusted to the bolt holes 9*a* of the support members 9, the height of a front portion of the frame 2 from the sandy soil surface with which the front ski-like members 3*a* contact (the mounting height of the front ski-like members 3*a* from the sandy soil surface to the frame 2) can be adjusted.

Meanwhile, each of the rear ski-like members 3*b* has a circular shape as viewed in plan and is formed in a shape wherein an outer circumferential edge thereof is curved upwardly in an arc. A support post 13, in the form of an angular tube having bolt holes 13*a* formed therein similarly to the support posts 11 described above, is secured to a central portion of an upper surface of each of the rear ski-like members 3*b*. By inserting the support posts 13 into the support members 10 and securing the support posts 13 to the support members 10 by means of bolts 12 screwed in the bolt holes 10*a* and 13*a* and nuts 12*a* screwed on the bolts 12, the rear ski-like members 3*b* are attached to a rear portion of the frame 2 such that the height of the rear portion of the frame 2 from the sandy soil surface (the mounting height of the rear ski-like members 3*b* from the sandy soil surface to the frame 2) can be adjusted.

On the front transverse member 8*a* of the frame 2, a plurality of scraper securing members 14 each formed from a pipe having a front end portion secured to the transverse member 8*a* are provided in a suitably spaced relationship from each other in the lengthwise direction of the transverse member 8*a* between the longitudinal members 7 and 7*a*. Each of the scraper securing members 14 is provided such that it extends in parallel to the longitudinal members 7 and 7*a* as viewed in plan and it is inclined such that it may overlap with the inclined portion 7*d* of the transverse member 8*a* as viewed in side elevation and has a length substantially equal to the inclined portion 7*d*.

Figure 4:
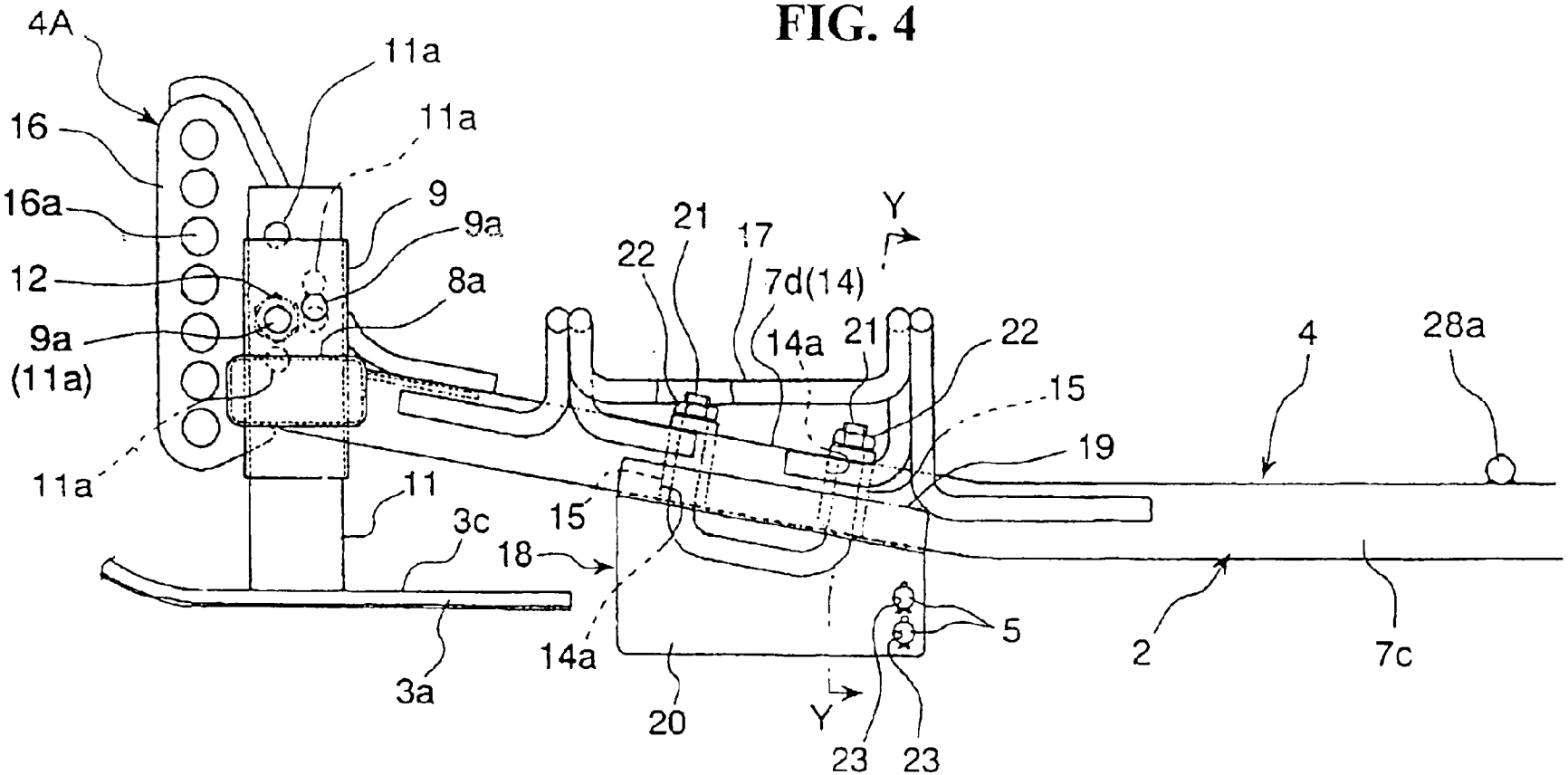
FIG. 4 is an enlarged detailed view of an portion A of FIG. 2.
Figure 5:
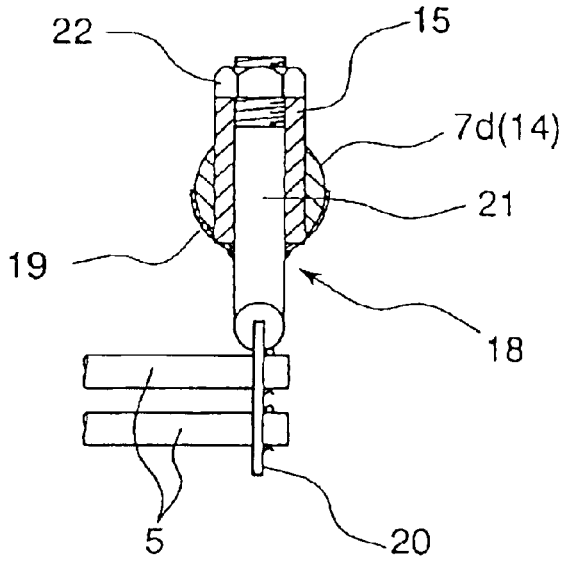
FIG. 5 is a sectional view taken along line Y—Y of FIG. 4.

At portions adjacent the free end of each of the scraper securing members 14 and portions of the longitudinal members 7 and 7*a* rearward of the inclined portions 7*d*, a pair of through-holes 14*a*, 14*a* are perforated upwardly and downwardly in a predetermined spaced relationship from each other in the forward and backward direction as shown in FIGS. 4 and 5, and cylindrical members 15 extending through the through-holes 14*a*, 14*a* and projecting upwardly from the longitudinal members 7 and 7*a* and the scraper securing members 14 are secured to the longitudinal members 7 and 7*a* and the scraper securing members 14 by welding or the like.

The towed portion 4A includes a pair of arresting brackets 16, 16 (one of which is not shown) each in the form of a vertical plate secured to symmetrical positions at equal distances on the left and right from the center of the front transverse member 8*a* (the center of the frame 2 in the widthwise direction). Each of the arresting brackets 16, 16 has a plurality of through-holes 16*a* provided in a suitably spaced relationship from each other in the upward and downward direction.

Further, two pairs of arm portions 17, 17 are provided fixedly at front side positions and positions rather rearward from the center of the longitudinal members 7, 7 on the opposite sides of the frame 2 such that they project to the opposite sides above the frame 2. The arm portions 17, 17 ride, when the traveling body 4 moves to a refuse station C which is hereinafter described, on a guide member 32 (refer to FIGS. 7 and 8) of the refuse station C to raise the traveling body 4 above the sandy soil surface.

Figure 6A:
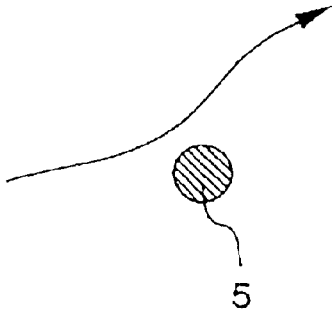
FIG. 6 is a view showing examples of a transverse sectional shape of a bar-like scraper.
Figure 6B:
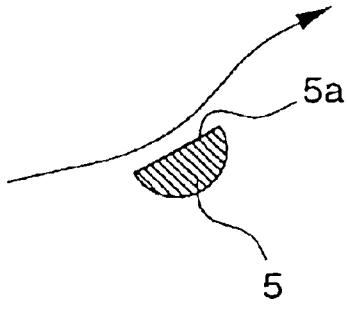
Figure 6C:
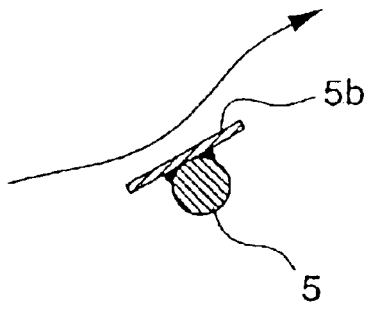

The bar-like scraper 5 includes a pair of bar-like members each having a circular cross section (refer to (a) of FIG. 6) and a length substantially equal to the length of the front transverse member 8*a* and spaced by a predetermined distance from each other in the upward and downward direction. The bar-like scraper 5 is supported on the frame 2 by scraper supporting members 18 attached to the inclined portions 7*d* of the longitudinal members 7 and 7*a* of the frame 2 and the scraper securing members 14.

As shown in FIGS. 4 and 5, each of the scraper supporting members 18 includes a mounting bracket 19 having a semi-arcuate transverse section, a support plate 20 in the form of a flat plate secured in a vertical direction (diametrical direction of the arc) on the undersurface of the mounting bracket 19 and extending along the lengthwise direction of the mounting bracket 19, and a pair of bolts 21, 21 secures to the support plate 20 and extending in the opposite direction to that of the support plate 20 through the mounting bracket 19.

Each of the bolts 21, 21 is a U-shaped bolt and is secured at a bottom side portion thereof to the support plate 20 while the distance in the lengthwise direction of the mounting bracket 19 is equal to the distance between the centers of the cylindrical members 15, 15 secured to the longitudinal members 7 and 7*a* and the scraper securing members 14. By inserting the bolts 21, 21 from below into the cylindrical members 15 and tightening the bolts 21, 21 with nuts 22, the mounting bracket 19 is secured to the longitudinal members 7 and 7*a* and the scraper securing members 14 in a state wherein the arcuate surface thereof contacts with the longitudinal members 7 and 7*a* and a lower half of the scraper securing members 14.

Further, at positions adjacent the rear end of each of the support plates 20, a pair of insertion holes 23 are perforated in a predetermined spaced relationship from each other in the upward and downward direction through the support plate 20 such that they extend in a direction perpendicular to the support plate 20 (widthwise direction of the traveling body 4). The bar-like scrapers 5 are inserted in the insertion holes 23 and are supported by the support plates 20 such that they are supported on the scraper supporting members 18.

At the opposite end portions of each of the bar-like scrapers 5, pull-off prevention means are formed from a cotter pin, a fastening screw, a nut or the like is provided in order to prevent the bar-like scraper 5 from being pulled off from the support plates 20. This pull-off prevention means allows removal or attachment of the bar-like scraper 5 from or to the support plates 20 when this is required.

While the two bar-like scrapers 5 are provided at upper and lower positions of the scraper supporting members 18, the number of bar-like scrapers 5 is not limited to two but may be 1 or 3 or more. Where a plurality of such bar-like scrapers 5 are provided, they may be disposed not at upper and lower positions, but at left and right positions extending horizontally or obliquely with the front side positioned at a lower position.

The refuse reclamation section 6 includes a lower frame member 24 of a rectangular shape placed on a rear half portion of the frame 2 and formed like a grid from longitudinal and transverse members, a pair of side frame members 25, 25 (one side is not shown in FIG. 1) are provided uprightly along the opposite sides of the lower frame member 24. A rear frame member 26 is provided uprightly along a rear end of the lower frame member 24. A net member 27 extends between the lower frame member 24, side frame members 25, 25 and rear frame member 26.

The refuse reclamation section 6 is blocked from movement in the forward or backward direction as front and rear edges of the lower frame member 24 contacts with stoppers 28*a* secured to the lower horizontal portions 7*c* of the longitudinal members 7 and 7*a* of the frame 2 and stoppers 28*b* secured to rear end portions of the horizontal portions 7*b*. Further, the refuse reclamation section 6 is blocked from movement in the upward or downward direction and in the leftward or rightward direction as a hook 29*a* of an arresting member 29 supported for pivotal motion in the leftward and rightward direction on each of the rear arm portions 17 of the frame 2 is hooked by each of the side frame members 25.

A pair of carrying handles 30, 30 for lifting the refuse reclamation section 6 in order to remove or mount the refuse reclamation section 6 from or onto the frame 2 are secured to front and rear portions of each of the side frame members 25 such that they project sideward.

Figure 7:
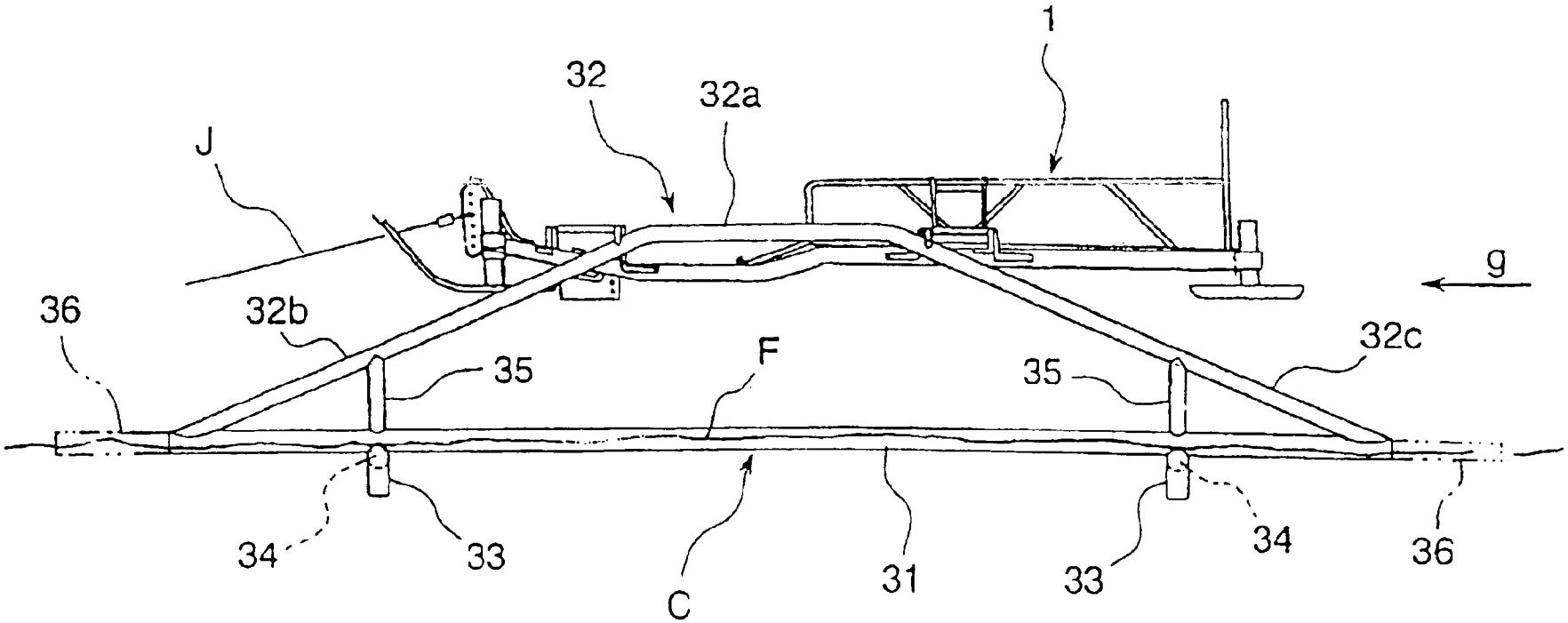
FIG. 7 is a plan view of the beach cleaner at a refuse reclamation station.
Figure 8:
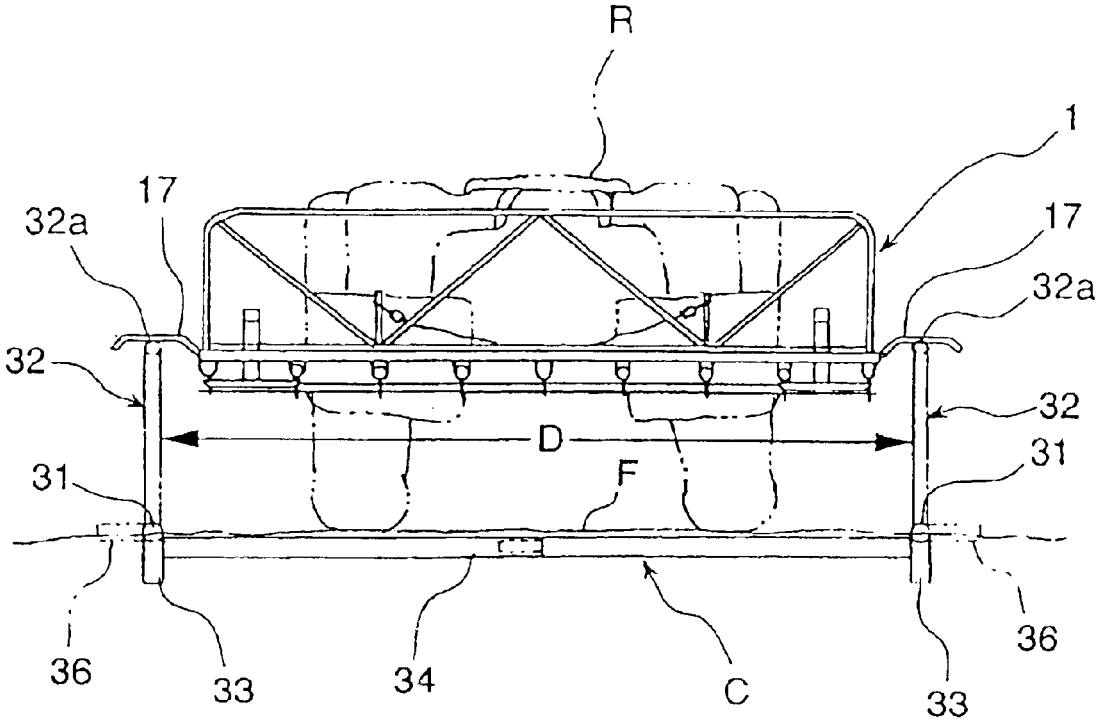
FIG. 8 is a view as viewed in the direction of arrow mark g in FIG. 7.
Figure 9:
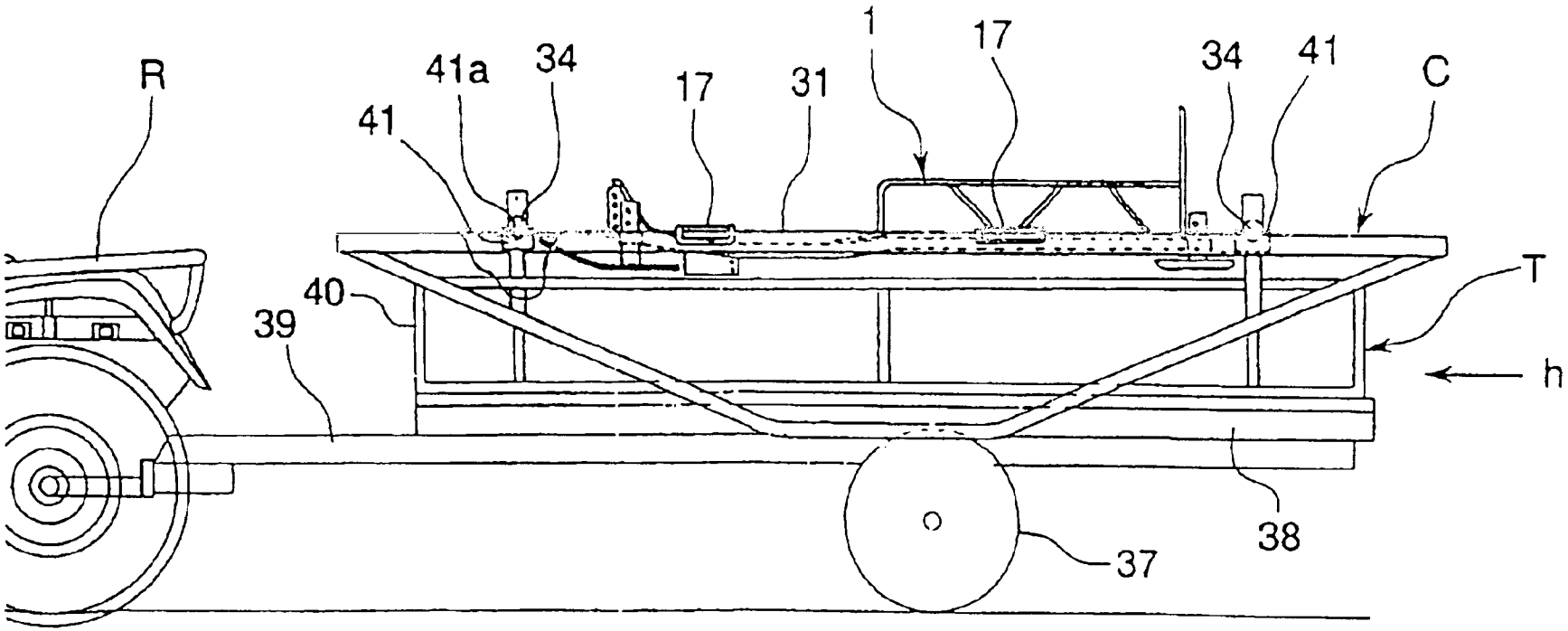
FIG. 9 is a side elevational view of a trailer for the beach cleaner.
Figure 10:
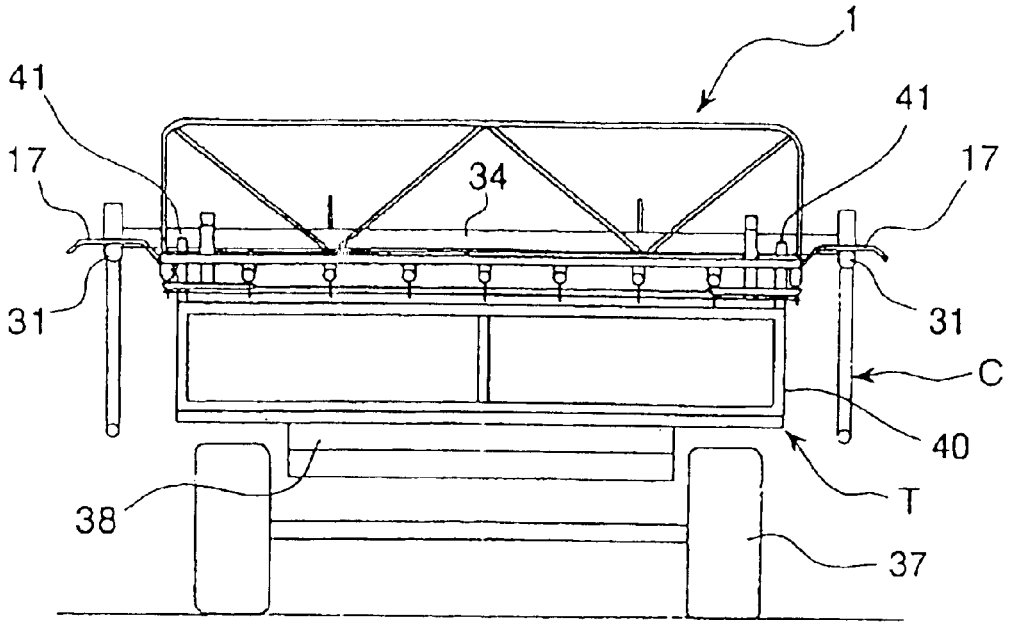
FIG. 10 is a view as viewed in the direction of arrow h in FIG. 9.

Subsequently, the refuse station C for raising the beach cleaner 1 above the sand includes, as shown in FIGS. 7 and 8, a pair of earth contact members 31, 31 each formed from a pipe member and disposed horizontally and in parallel to each other in a predetermined spaced relationship from each other, a pair of guide members 32 each formed from a pipe member and secured at the opposite front and rear end portions thereof to the earth contact members 31, 31 in such a manner as to be disposed vertically, pairs of foot members 33, 33 each formed from a pipe member and secured to the earth contact members 31, 31 at positions displaced to the inner side from the opposite end portions of the earth contact members 31, 31 such that they project downwardly, and a pair of left and right connection members 34, 34 each formed from a pipe member and connecting the earth contact members 31, 31 and the foot members 33, 33 to each other.

The guide members 32, 32 are formed symmetrically in the forward and backward direction such that intermediate portions thereof in the longitudinal direction are formed as horizontal portions 32*a*, 32*a* and portions thereof on the front and rear end portion sides of the horizontal portions 32*a*, 32*a* are bent downwardly at an obtuse angle to form inclined portions 32*b* and 32*c*. The distance D between the guide members 32 is set to a dimension which is greater than the width of the frame 2 of the beach cleaner 1 and the traction vehicle R and with which the guide members 32 engage with the arm portions 17, 17 of the frame 2. The horizontal portions 32*a* of the guide members 32 are set to a vertical position with which, when the beach cleaner 1 rides on the horizontal portions 32*a*, the bar-like scrapers 5 of the beach cleaner 1 are spaced sufficiently from the sand upper surface F.

Each of the connection members 34, 34 is divided into two portions at a mid portion thereof, and the divisional portions are so structured that they are removably connected to each other. Consequently, when necessary, the refuse station C can be separated into two portions.

It is to be noted that the earth contact members 31 and the guide members 32 are coupled to each other at positions the same as those of the foot members 33 and the connection members 34 in the forward and backward direction by reinforcing members 35, 35.

Further, as indicated by chain lines in FIGS. 7 and 8, a pair of end portion guide members 36, 36 which are removably attached to front and rear end portions of each of the earth contact members 31 and used when necessary are provided on the refuse station C. Each of the end portion guide members 36, 36 is so shaped that the opposite side to the movably attached side thereof to the earth contact members 31 gradually expands outward.

Now, a trailer T for receiving and carrying the beach cleaner 1 or the refuse reclamation station C is described.

The trailer T includes a body 38 having a pair of wheels 37, 37 provided on the left and right thereof, a connector 39 is provided at a front portion of the body 38 for connecting to the traction vehicle R. A pedestal 40 is provided fixedly on the body 38 and formed in a box shape from a die steel member or the like. The pedestal 40 has a length a little smaller than the length of the refuse reclamation station C and has a width substantially equal to the width of the frame 2 of the beach cleaner 1. Totaling four receiving elements 41 for receiving the refuse station C are provided fixedly at front and rear, left and right locations of the pedestal 40.

Each of the receiving elements 41 has a V-shaped recess 41*a* formed on an upper surface thereof. The distance between the front and rear V-shaped recesses 41*a*, 41*a* is set equal to the distance between the connection members 34, 34 of the refuse reclamation station C such that the refuse reclamation station C in an upside-down state is placed on the pedestal 40 with the connection members 34, 34 fitted in the front and rear V-shaped recesses 41*a*, 41*a*.

Further, the beach cleaner 1 is placed on the pedestal 40 with the arm portions 17, 17 of the frame 2 thereof engaged with the earth contact members 31, 31 of the refuse reclamation station C placed on the pedestal 40 through the receiving elements 41.

Subsequently, the operation of the beach cleaner 1 having the configuration described above is described.

First, the beach cleaner 1 is placed onto the pedestal 40 of the trailer T together with the refuse reclamation station C, and the trailer T is towed by the traction vehicle R so that it is transported to a beach such as a bathing-place from which refuse is to be reclaimed.

Figure 11:
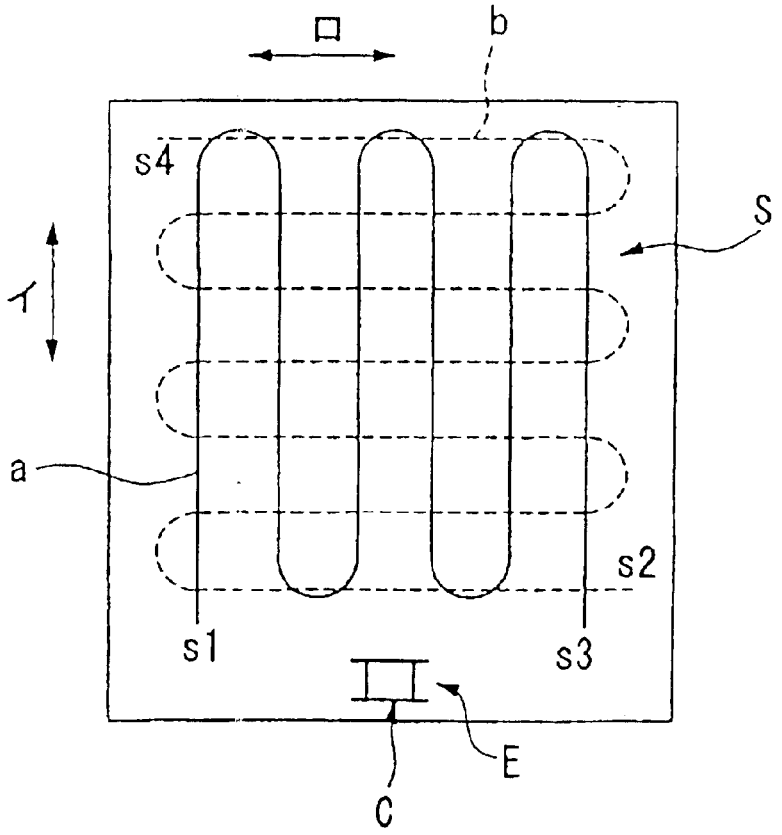
FIG. 11 is an explanatory view of a traveling path of the beach cleaner in a cleaning region of a beach.

Prior to cleaning of the beach, the refuse reclamation station C is removed from the trailer T and placed onto the sandy soil at a suitable refuse reclaiming place E of a cleaning area S of the beach as shown in FIG. 11.

Then, the beach cleaner 1 is connected at the towed portion 4A thereof to the traction vehicle R by a string member J and towed to move to a cleaning start point s1 of the cleaning area S, at which refuse reclaiming on the beach is started.

Upon such refuse reclaiming, the beach cleaner 1 is towed by the traction vehicle R so that the beach cleaner 1 travels back and forth at a speed of 15 to 25 km/h along a traveling path a in one of a longitudinal direction X and a transverse direction Y perpendicular to the longitudinal direction X, for example, in the longitudinal direction X. In this instance, since the bar-like scrapers 5 of the beach cleaner 1 are pierced in a surface layer portion of the sandy soil of the beach and move in this state, the sand is scraped up by the bar-like scrapers 5 and pieces of refuse in the sand are dug up and thrown rearwardly together with the sand and pieces of refuse on the sand. While the pieces of refuse thrown rearwardly together with the sand include cigarette butts, PET bottles and caps therefor, empty cans and comparatively small pieces of refuse such as paper wastes in a mixed state, when they drop onto the net member 27 of the refuse reclamation section 6 of the beach cleaner 1, they are separated from the sand by an impact upon the dropping and so forth and collected on the net member 27. The sand separated from the refuse drops to the sandy soil through the meshes of the net member 27.

When the beach cleaner 1 comes to a terminal end of the traveling path a, it is moved to the refuse reclaiming place E.

Then, when the traction vehicle R passes at a low speed between the pair of guide member 32 of the refuse reclamation station C, the arm portions 17, 17 of the traveling body 4 thereof move along the guide member 32, whereupon they are raised from the sand earth surface F. Thus, when the arm portions 17, 17 are raised to their horizontal position, the movement of the beach cleaner 1 is stopped once (refer to FIG. 7). In the meantime, comparatively long pieces of refuse such as strings, ropes and pieces of wood caught by the bar-like scrapers 5 naturally drop to the sand. The dropping pieces of refuse are collected suitably, and the refuse reclamation section 6 is removed from the frame 2 of the beach cleaner 1 and the pieces of refuse collected by the net member 27 are reclaimed. If some piece of refuse is entangled with the bar-like scrapers 5 and does not drop naturally, then any tool can be used suitably to scrape off it simply.

After the beach cleaner 1 is moved to run along the traveling path a in the longitudinal direction X until the reclaiming of refuse comes to an end, the traction vehicle R is advanced to unload the beach cleaner 1 from the refuse reclamation station C and the beach cleaner 1 is positioned at another cleaning start point s2 for the transverse direction Y, whereafter the beach cleaner 1 is moved back and forth to travel along another traveling path b to perform reclamation of refuse in a similar manner as described above.

It is to be noted that, when the beach cleaner 1 travels back and forth along the traveling paths a and b in the longitudinal direction X and the transverse direction Y, it moves laterally at each turning back location to a side on which cleaning is not performed as yet, and in order that a portion of the beach which is not cleaned may not remain, the distance (pitch) between the forward stroke and the backward stroke then is preferably set substantially equal to the width of the beach cleaner 1.

Naturally, even while the beach cleaner 1 is traveling intermediately along the traveling path a or b, if the refuse reclamation section 6 is filled with refuse, then the beach cleaner 1 is moved to the refuse reclamation station C to reclaim the refuse.

It is to be noted that the refuse reclaiming by the beach cleaner 1 is performed usually after another beach cleaner prepared separately and having a plurality of pin members projecting downwardly from a traveling body is caused to travel at a comparatively low speed to dig up the sandy soil with the pin members to catch elongated pieces of refuse such as ropes and nets in the sandy soil with the pin members to reclaim them.

With the beach cleaner 1 described above, since a pair of bar-like scrapers 5 are provided at a lower portion of the frame 2 and extend along the overall length in the widthwise direction of the traveling body 4, sand of sandy soil can be dug up over a wide range and pieces of refuse in the sand can be thrown away rearward together with the sand and pieces of refuse on the surface of the sand efficiently by the bar-like scrapers 5 so that they can be collected with certainty into the net member 27 of the refuse reclamation section 6. Consequently, a reclaiming operation for cans, PET bottles and caps therefor and comparatively small pieces of refuse such as pieces of wood scattered on the beach can be performed efficiently.

In the refuse reclaiming operation described above, the depth over which the bar-like scrapers 5 pierce into the sandy soil is adjusted in accordance with the quality of the sandy soil, a characteristic of the sand such as a dry state, the traveling speed of the traveling body 4 and so forth by varying the mounting height of the front ski-like members 3*a* or the mounting heights of the front and rear ski-like members 3*a* and 3*b* with respect to the frame 2. Consequently, pieces of refuse can be dropped precisely onto the net member 27 of the refuse reclamation section 6 together with the sand thereby to efficiently reclaim the refuse.

The adjustment of the mounting height or heights can be performed by changing the positions of the bolt holes 11*a* and 13*a,* which are provided at different positions in the vertical direction of the support posts 11 and 13 of the ski-like members 3*a* and 3*b,* into which bolts are to be inserted. If the mounting heights of both of the ski-like members 3*a* and 3*b* are adjusted, then the depth over which the bar-like scrapers 5 pierce into the sandy soil can be adjusted finely, and the traveling resistance to the traveling body 4 can be adjusted.

The arresting position of the string member J such as a chain or a wire for connecting the traction vehicle R and the traveling body to each other to the through-holes 16*a* of the arresting brackets 16 may be suitably changed upwardly or downwardly together with the adjustment of the mounting height or heights.

Besides, since the beach cleaner 1 includes the bar-like scrapers 5 provided at a lower portion of the frame 2 of the traveling body 4 as principal components but does not include, in the refuse reclamation section thereof, a source of power or a power transmission apparatus for driving the refuse reclamation section, the overall configuration is simple and is small in size and light in weight, and the production cost is low. In addition, the beach cleaner 1 suffers less likely from failure and facilitates maintenance and inspection. Further, since the traction vehicle R is not integrated with the refuse reclamation section, the traction vehicle R can be used for another application while the beach cleaner 1 is not used, and therefore, augmentation of the utilization is achieved as a whole and the cost for maintenance is reduced.

It is to be noted that, in the beach cleaner 1 of the embodiment described above, since each of the bar-like scrapers 5 is formed with a circular transverse section as shown in (a) of FIG. 6, it can move smoothly with reduced resistance in the sandy soil and dig up pieces of refuse in the sand well to reclaim them into the refuse reclamation section 6. However, the transverse sectional shape of the bar-like scrapers 5 is not limited to a circular shape but may otherwise be, for example, as shown in (b) of FIG. 6, a crescent shape wherein an upper surface thereof is formed as a plain surface 5*a* which is inclined such that the leading side thereof in the traveling direction of the traveling body 4 is positioned at a lower position. With the configuration just described, the bar-like scrapers 5 can efficiently throw away pieces of refuse rearwardly together with sand without increasing the traveling resistance to the traveling body 4. The transverse sectional shape of the bar-like scrapers 5 may not be the crescent shape described above but otherwise a quadrangular, triangular, elliptical or some other transverse sectional shape. Also in such instances, preferably the bar-like scrapers 5 are disposed such that the front side of the upper surface thereof is positioned at a lower position.

Also it is possible to adopt such a configuration as shown in (c) of FIG. 6 wherein a flat plate 5*b* is secured along an upper portion of a bar-like scraper 5 of a circular transverse section in an inclined condition wherein the front side thereof is positioned at a lower position. With the configuration just described, the scraping up effect and the rearward scattering effect of sand by the bar-like scrapers 5 are augmented, and refuse can be reclaimed further efficiently.

Further, in the beach cleaner 1 of the embodiment described above, the depth over which the bar-like scrapers 5 pierce into sandy soil is adjusted by changing the mounting height of the front ski-like members 3*a* or the mounting heights of the front and rear ski-like members 3*a* and 3*b* with respect to the frame 2. However, the adjustment of the depth is not limited to this, and alternatively, a plurality of scraper supporting members 18 among which the vertical positions in the upward and downward direction of the insertion holes 23 in the support plate 20 are different may be prepared and selectively attached to the scraper securing member 14 in case of necessity.

As described above, according to the present invention, the following superior effects are exhibited.

With the beach cleaner according to claim 1, since the bar-like scraper is provided such that it extends in the widthwise direction of the traveling body, the sand of the sandy soil can be dug up over a wide range by the bar-like scraper, and pieces of refuse in the sand can be efficiently thrown rearwardly together with pieces of refuse on the surface and the sand so that they can be collected with certainty by the refuse reclamation section. Consequently, a reclaiming operation of cans, PET bottles and caps therefor and comparatively small pieces of refuse such as pieces of wood scattered on the beach can be performed efficiently.

Besides, since the beach cleaner includes the bar-like scraper provided on the traveling body as a principal component but does not include, in the refuse reclamation section thereof, a power source or a power transmission apparatus for driving the refuse reclamation section, the overall configuration can be made simple, small in size and light in weight, and the production cost is low. Furthermore, the beach cleaner suffers less likely from failure and facilitates maintenance and inspection. Further, since the traction vehicle is not integrated with the refuse reclamation section, the traction vehicle can be used for another application while the beach cleaner is not used, and therefore, augmentation of the utilization is achieved as a whole and the cost for maintenance can be reduced.

With the beach cleaner according to the present invention, since the bar-like scraper has a transverse section formed in a circular shape, it can be moved smoothly with reduced resistance in the sandy soil, and pieces of refuse in the sand can be dug up well and reclaimed into the refuse reclamation section.

With the beach cleaner according to the present invention, since pieces of refuse of the sandy soil are scooped up well and thrown way upwardly rearwards by the inclined upper surface of the bar-like scraper, pieces of refuse can be collected precisely into the refuse reclamation section.

With the beach cleaner according to the present invention, since the bar-like scraper is provided with a comparatively wide scooping up surface by the inclined flat plate, pieces of refuse of the sandy soil can be scooped up more effectively and reclaimed into the refuse reclamation section.

With the beach cleaner according to the present invention, the rearward dispersion distance of pieces of refuse can be adjusted by adjusting the inclination angle of the upper surface of the bar-like scraper. The pieces of refuse can be reclaimed efficiently by the reclamation member.

With the beach cleaner according to the present invention, the refuse reclaiming ratio in the sand can be adjusted by adjusting the piercing amount of the bar-like scraper into the sandy soil.

With the beach cleaner according to the present invention, traveling of the traveling body on the sandy soil can be performed smoothly and the piercing amount of the bar-like scraper into the sandy soil can be maintained stably by the ski-like members.

With the beach cleaner according to the present invention, the piercing amount of the bar-like scraper into the sandy soil can be adjusted readily and appropriately by adjusting the mounting height of the ski-like members from the surface of the sandy soil to the frame.

With the beach cleaner according to the present invention, pieces of refuse scooped up together with the sand and thrown rearwardly by the bar-like scraper can be separated from the sand and collected by the net member and reclaimed efficiently into the reclamation member.

With the beach cleaner according to the present invention, by preparing and exchangeably using a plurality of net members for the refuse collection member different in size of the meshes, pieces of refuse can be separated depending on the size, type or the like and reclaimed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A beach cleaner adapted for towing by a traction vehicle for reclaiming refuse comprising:

a traveling body including a frame formed from a longitudinal member extending in a traveling direction and a transverse member extending in a widthwise direction perpendicular to said longitudinal member and adapted to be towed by a traction vehicle through a towed portion provided at a front portion of said frame;

a pair of longitudinal members having inclined portions bent upward at a front portion of said traveling body;

a pair of support plates supported by scraper supporting members provided on said inclined portions of the longitudinal members, each of the support plates having an insertion hole;

a bar-like scraper inserted into the insertion hole in each of the support plates and extending in the widthwise direction of said traveling body for scraping up refuse during operation of said traveling body;

a pair of ski-like members for contacting with a ground surface are provided at least at opposite side positions of said front portion of said frame; and a refuse reclamation section provided on said traveling body rearwardly of said bar-like scraper for collecting the refuse scraped up by said bar-like scraper.

2. The beach cleaner according to claim 1, wherein said bar-like scraper has a transverse section formed in a circular shape.

3. The beach cleaner according to claim 1, wherein said bar-like scraper has a transverse section formed in a crescent shape and includes an upper surface that is inclined wherein a leading portion thereof in the traveling direction of said traveling body is positioned to be lower than a trailing portion thereof.

4. The beach cleaner according to claim 1, wherein said bar-like scraper has an inclined flat plate secured thereto and said flat plate has an upper surface inclined such that a leading portion thereof in the traveling direction of said traveling body is positioned lower than a trailing portion thereof.

5. The beach cleaner according to claim 3, wherein the inclination angle of the upper surface of said bar-like scraper is variable.

6. The beach cleaner according to claim 4, wherein the inclination angle of the upper surface of said bar-like scraper is variable.

7. The beach cleaner according to claim 1, wherein said bar-like scraper is mounted wherein a piercing amount thereof into soil is adjustable.

8. The beach cleaner according to claim 2, wherein said bar-like scraper is mounted wherein a piercing amount thereof into soil is adjustable.

9. The beach cleaner according to claim 3, wherein said bar-like scraper is mounted wherein a piercing amount thereof into soil is adjustable.

10. The beach cleaner according to claim 4, wherein said bar-like scraper is mounted wherein a piercing amount thereof into soil is adjustable.

11. The beach cleaner according to claim 5, wherein said bar-like scraper is mounted wherein a piercing amount thereof into soil is adjustable.

12. The beach cleaner according to claim 1, wherein said refuse reclamation section includes a grid-like member and a net member stretched on said grid-like member.

13. The beach cleaner according to claim 1, wherein said refuse reclamation section is removably supported on said traveling body.

14. A beach cleaner adapted for towing by a traction vehicle for reclaiming refuse comprising:

a traveling body including a frame formed from a longitudinal member extending in a traveling direction and a transverse member extending in a widthwise direction perpendicular to said longitudinal member and adapted to be towed by a traction vehicle through a towed portion provided at a front portion of said frame;

a bar-like scraper provided at a lower portion of a front portion of said traveling body, said bar-like scraper extending in the widthwise direction of said traveling body for scraping up refuse during operation of said traveling body; and a refuse reclamation section provided on said traveling body rearwardly of said bar-like scraper for collecting the refuse scraped up by said bar-like scraper, wherein said bar-like scraper has a transverse section formed in a crescent shape and includes an upper surface that is inclined wherein a leading portion thereof in the traveling direction of said traveling body is positioned to be lower than a trailing portion thereof.

15. The beach cleaner according to claim 14, wherein a pair of ski-like members for contacting with a ground surface are provided at least at opposite side portions of said front portion of said frame.

16. A beach cleaner adapted for towing by a traction vehicle for reclaiming refuse comprising:

a traveling body including a frame formed from a longitudinal member extending in a traveling direction and a transverse member extending in a widthwise direction perpendicular to said longitudinal member and adapted to be towed by a traction vehicle through a towed portion provided at a front portion of said frame;

a pair of longitudinal members having inclined portions bent upward at a front portion of said traveling body;

a pair of support plates supported by scraper supporting members provided on said portions of the longitudinal members, each of the support plates having an insertion hole;

a bar-like scraper inserted into the insertion hole in each of the support plates and extending in the widthwise direction of said traveling body for scraping up refuse during operation of said traveling body;

ski-like members having support posts; and a refuse reclamation section provided on said traveling body rearwardly of said bar-like scraper for collecting the refuse scraped up by said bar-like scraper.

17. The beach cleaner according to claim 16, wherein said bar-like scraper has a transverse section formed in a crescent shape and includes an upper surface that is inclined wherein a leading portion thereof in the traveling direction of said traveling body is positioned to be lower than a trailing portion thereof.

18. The beach cleaner according to claim 16, wherein a pair of ski-like members for contacting with a ground surface are provided at least at opposite side portions of said front portion of said frame.

* * * * *